United States Patent [19]

Hollyoak

[11] 4,206,656

[45] Jun. 10, 1980

[54] STARTER MOTOR

[75] Inventor: John D. Hollyoak, West Midlands, England

[73] Assignee: Lucas Industries Limited, Birmingham, England

[21] Appl. No.: 920,243

[22] Filed: Jun. 29, 1978

[30] Foreign Application Priority Data

Jul. 1, 1977 [GB] United Kingdom ..... 27717/77

[51] Int. Cl.[2] ..... F02N 15/06

[52] U.S. Cl. ..... 74/6; 74/7 A

[58] Field of Search ..... 74/7 R, 7 A, 6; 192/42

[56] References Cited

U.S. PATENT DOCUMENTS 3,922,558 11/1975 Hollyoak ..... 74/7 A 4,104,926 8/1978 Wilson ..... 74/6

FOREIGN PATENT DOCUMENTS 2439981 3/1976 Fed. Rep. of Germany ..... 74/7 A

*Primary Examiner*—Wayne L. Shedd

*Attorney, Agent, or Firm*—Holman & Stern

[57] ABSTRACT

An internal combustion engine starter motor of the kind wherein the pinion gear wheel assembly includes a roller clutch. The small diameter drive sleeve of the clutch is encircled by an annular seal and the seal engages the sleeve and an annular barrier member, the barrier member sealingly engaging the housing of the starter motor at its outer periphery.

5 Claims, 5 Drawing Figures

STARTER MOTOR

This invention relates to a starter motor for an internal combustion engine, of the kind including a housing, a shaft rotatable in the housing by an electric motor, and a pinion gear wheel assembly carried by the shaft, the pinion gear wheel assembly comprising a pinion gear wheel and a roller clutch, the assembly being movable axially relative to the shaft between a rest position and an operative position and the roller clutch transmitting rotational movement of the shaft in one direction to the gear wheel to rotate the gear wheel and including an elongate sleeve through which the shaft extends and a cup-shaped part at one end of the sleeve into which a part associated with the gear wheel extends and within which the rollers, springs, and cam forms of the clutch are located, said sleeve being of smaller diameter than said cup-shaped part.

In starter motors of the kind specified there is a problem in that dirt and moisture can enter the mechanism of the starter motor by way of the gap between the roller clutch and the housing. An attempt has been made to minimise this problem by mounting an annular seal on the housing the seal engaging the cylindrical outer surface of the cup-shaped part of the roller clutch. This attempt is unsatisfactory in that firstly since the diameter of the cup-shaped part is large then during relative rotation between the part and the seal the rubbing speed of the surfaces is high leading to rapid wear and secondly the axial length of the cup-shaped part is often insufficient to accommodate the travel of the pinion assembly between its rest and operative positions, and disengagement of the seal from the cup-shaped part occurs at some point in the travel. A compromise can be achieved in which the seal and cup-shaped part are interengaged in the rest positions but this compromise arrangement suffers from the problem that the seal must accommodate the repeated engagement and disengagement of the cup-shaped part and of course the cup-shaped part will still be rotating as it returns to its rest position. It is an object of the present invention to provide a starter motor of the kind specified wherein the foregoing problems are minimised.

According to the invention in a starter motor of the kind specified an annular seal encircles and sealingly engages the outer cylindrical surface of the sleeve of the roller clutch, and the seal also sealingly engages in an annular barrier member, the barrier member being sealingly engaged at its outer periphery with the housing.

Preferably, a compression spring encircles the sleeve and acts at one end against an abutment carried by the sleeve, the spring acting at its other end against the barrier member, the spring urging the pinion gear wheel assembly to its rest position.

Conveniently the barrier member abuts an annular gasket interposed between the member and an annular shoulder on the housing, said spring serving to trap the barrier member against the shoulder of the housing.

Desirably the seal is interposed between the spring and the barrier member.

Preferably the spring traps the seal against the barrier member.

Alternatively the seal is secured to the face of the barrier member opposite to the face engaged by the spring.

One example of the invention is illustrated in the accompanying drawings wherein.

Figure 1:
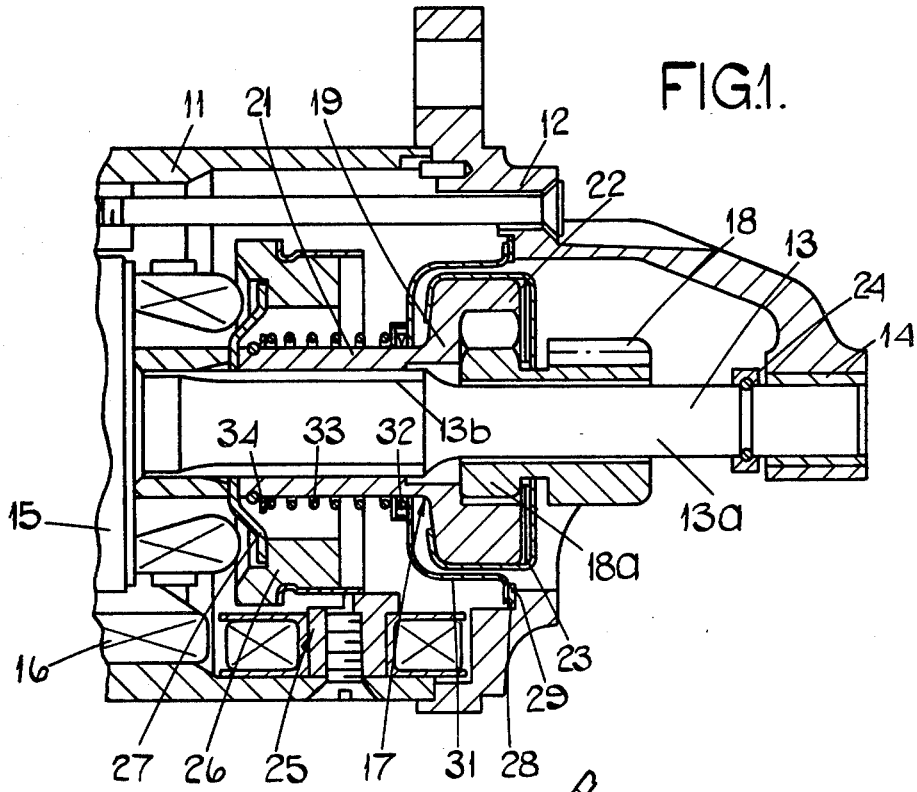
FIG. 1 is a diagrammatic sectional view of part of a starter motor for an internal combustion engine.
Figure 2:
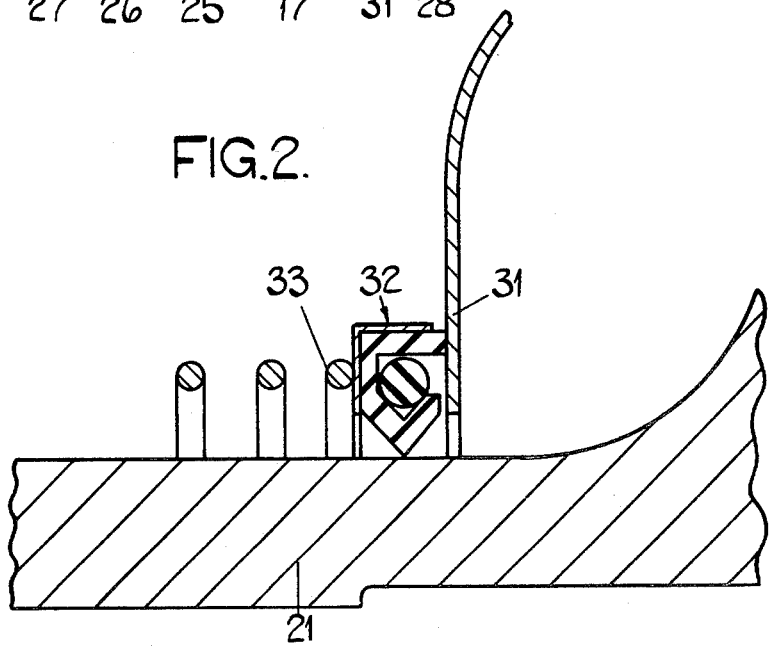
FIG. 2 is a diagrammatic sectional view of part of FIG. 1 to a greatly enlarged scale.

Referring to the drawings the starter motor comprises a cylindrical hollow housing 11 incorporating at one end a drive end bracket 12 partially closing the housing. Journalled for rotation within the housing, is a rotor shaft 13, one of the bearings 14 of the rotor shaft being defined in the drive end bracket 12.

Within the housing 11 the shaft 13 carries the rotor assembly 15 of an electric motor, the housing 11 supporting the stator assembly 16 of the electric motor. Intermediate the rotor assembly 15 and bearing 14 the rotor shaft includes a plane region **13*a* of reduced diameter and a helically splined region 13*b*. Supported by the shaft 13 between the bearing 14 and the rotor assembly 15 is a pinion gear wheel assembly 17 including a pinion gear wheel 18 and a roller clutch 19. The roller clutch 19 includes an elongate sleeve 21 the inner surface of which is formed with helical splines mating with the gelical splines on the region 13*b* of the shaft 13. At its end presented to the bearing 14 the sleeve 21 includes an integral cup-shaped portion 22 of large diameter and short axial length by comparison with the sleeve 21. The pinion gear wheel 18 includes a portion 18*a* which extends into the cup-shaped portion 22 the cup-shaped portion 22 accommodating the rollers and springs of the roller clutch, and defining on its inner periphery cam forms and spring abutments of the roller clutch. An outer shell 23 retains the parts of the roller clutch within the cup-shaped part 22**.

The pinion gear wheel assembly 17 is movable from a rest position (shown in FIG. 1) to an operative position wherein the pinion gear wheel 18 abuts a stop 24 on the shaft 13 adjacent the bearing 14. It will be appreciated that by virtue of the helical spline connection between the shaft 13 and the sleeve 21, the pinion gear wheel assembly can move axially relative to the shaft between its rest and its operative positions, and can also be driven by the shaft as the shaft rotates. It is to be understood that the axial move of the pinion gear wheel assembly between its rest and its operative position is accompanied by rotation of the assembly relative to the shaft. The roller clutch 19 ensures that the pinion gear wheel 18 rotates with the shaft 13 in one direction of rotation of the shaft, but can rotate relative to the shaft in the opposite direction. The arrangement of the clutch is such that the pinion gear wheel 18 rotates with the shaft 13 to crank an engine to be started but permits the pinion gear wheel 18 to overrun the shaft 13 if it remains in engagement with the ring gear of the engine when the engine has started.

The mechanism whereby the pinion gear wheel assembly is moved from its rest position at its operative position is not of great importance to the present invention. However as shown in the drawings an electromagnet 25 is secured within the housing and includes a pair of diametrically opposed electromagnetic poles (only one of which is shown in the drawings) projecting radially inwardly from the inner periphery of the housing 11. Associated with the electromagnet is an annular armature 26 encircling the sleeve 21 and carrying an annular disc 27 abutting the axial end of the sleeve 21 remote from the cup-shaped part 22. In the rest position of the pinion gear wheel assembly the armature 26 is spaced axially from the poles of the electromagnet 25. Upon energisation of the electromagnet 25 the armature 26 is attracted towards the poles and thus pushes the pinion gear wheel assembly towards the stop 24.

It will be appreciated that in the construction so far described an annular clearance exists between the outer periphery of the roller clutch assembly and the inner surface of the housing whereby dirt and moisture can enter the housing. Clearly ingress of dirt and moisture can impair the efficiency of the electric motor and of the mechanism for moving the pinion gear wheel assembly. In order to seal the housing against such ingress the housing is formed with an annular shoulder 28. Abutting the annular shoulder 28 is an annular gasket 29 and abutting the gasket 29 is the periphery of a cup-shaped barrier member 31. The cup-shaped barrier member 31 is shaped to accommodate the cup-shaped portion 22 of the roller clutch in the rest position thereof and the barrier member 31 terminates, at its inner periphery adjacent the cylindrical outer surface of the sleeve 21. Abutting the barrier member 31 is an annular seal 32. The annular seal 32 encircles the sleeve 21 and is in sealing engagement with both the outer surface of the sleeve 21 and the barrier member 31. A helical compression spring 33 encircles the sleeve 21 and acts at one end against the seal 32 and at its other end against an abutment 34 on the sleeve 21. The seal 32 and the barrier member 31 are located radially by the sleeve 21 and the housing 11 respectively, and are located axially by the spring 33. The spring 33 urges the seal 32 axially firmly into engagement with the barrier member 31 to achieve sealing engagement therebetween, and further urges the barrier member 31 axially against the gasket 29. The gasket 29 of course abuts, and may be adhesively secured to, the shoulder 28.

It will be recognised therefore that a seal is achieved between the barrier member 31 and the housing, and between the barrier member 31 and the seal 32. The seal 32 sealingly engages the sleeve 21 and the sleeve 21 has an axial length which is in excess of the travel of the pinion assembly between its rest and operative positions. Thus the seal remains in engagement with the outer cylindrical surface of the sleeve 21 throughout the whole range of movement of the pinion gear wheel assembly. Furthermore, since the diameter of the sleeve 21 is relatively small, then the rubbing speed of the sleeve and the seal when the starter motor is operating is low by comparison with prior art arrangements where the seal engages the outer periphery of the large diameter cup-shaped portion 22.

The spring 33 in addition to urging the seal 32 and the member 31 axially also urges the pinion gear wheel assembly to its rest position. Thus the spring acts as the pinion return spring.

The seal 32 can take a number of forms, the prime requirement of course being that the seal can make sealing engagement with the barrier member 31 and the sleeve 21 bearing in mind the requirement for accommodation of rotation and axial movement between the sleeve 21 and the housing 11.

Figure 3:
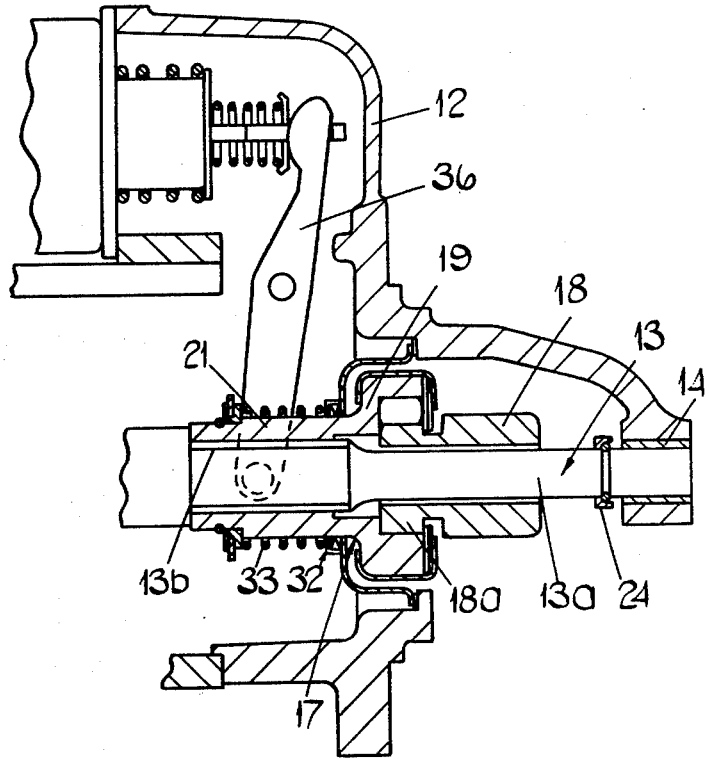
FIG. 3 is a view similar to FIG. 1 of a starter motor for an internal combustion engine in accordance with a second example of the present invention.
Figure 4:
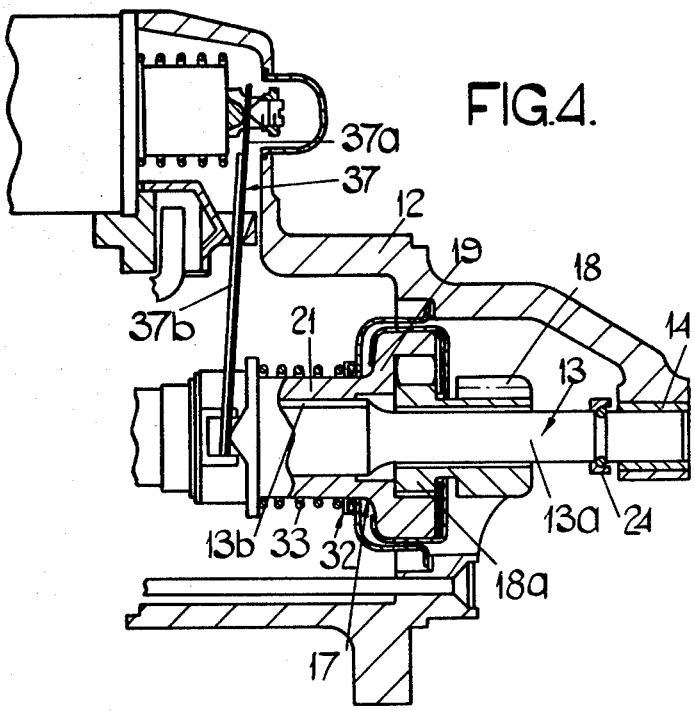
FIG. 4 is a view similar to FIG. 1 of part of a starter motor for an internal combustion engine in accordance with a third example of the present invention.

As mentioned above the mechanism whereby the pinion gear wheel assembly is moved from its rest position to its operative position is not of importance to the invention, and it will therefore be understood that alternative mechanism to the one described could be utilised. For example the annular disc 27 could be carried by a pivotted lever movement of which is achieved by an electromagnet mounted externally of the housing 11. Two different forms of arrangement are shown in FIGS. 3 and 4 respectively. In FIG. 3 the lever 36 is a rigid lever whereas in FIG. 4 there is shown a lever 37 which is resilient and comprises a pair of blades **37*a*, 37*b***.

It is to be understood that a similar seal arrangement to that described above can be applied to an inertia drive starter motor incorporating a roller clutch. In an inertia drive starter motor the pinion assembly is driven to its operative position by the action of a helical spline coupling between the pinion assembly and the motor shaft during relative rotation between the shaft and the pinion assembly, the inertia of the pinion assembly resisting rotation of the assembly as the shaft starts to rotate.

Figure 5:
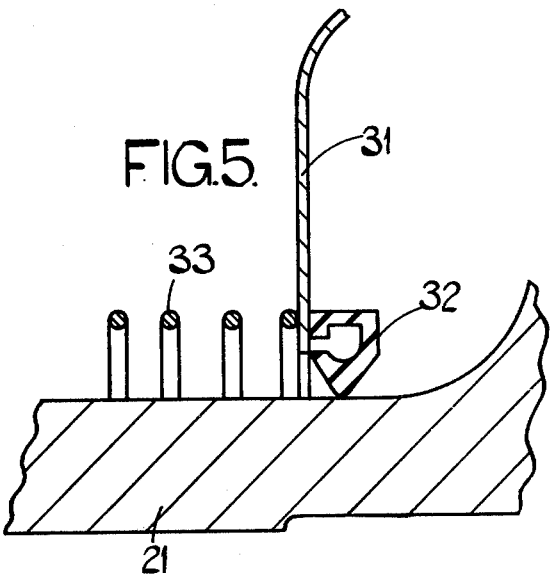
FIG. 5 is a diagrammatic view to an enlarged scale, similar to FIG. 2, but showing an alternative arrangement.

In a modification, as shown in FIG. 5, of any of the arrangements described above the seal 32 is bonded or otherwise sealingly secured to the face of the member 31 opposite the face engaged by the seal in the above arrangements. Thus instead of the spring 33 engaging the seal 32 it engages the barrier member 31.

It is to be understood that arrangements other than those including gasket 29 can be used to effect a seal between the housing and the barrier member.

I claim:

1. A starter motor, for an internal combustion engine, including a housing, a shaft rotatable in the housing by an electric motor, a pinion gear wheel assembly carried by the shaft, the pinion gear wheel assembly comprising a pinion gear wheel and a roller clutch, the assembly being movable axially relative to the shaft between a rest position and an operative position and the roller clutch transmitting rotational movement of the shaft in one direction to the gear wheel to rotate the gear wheel and including an elongate sleeve through which the shaft extends and a cup-shaped part at one end of the sleeve into which a part associated with the gear wheel extends and within which the rollers, springs and cam forms of the clutch are located, said sleeve being of smaller diameter than said cup-shaped part, an annular seal encircling and sealingly engaging the outer cylindrical surface of said sleeve and an annular barrier member, said barrier member being sealingly engaged at its outer periphery with the housing, and, a compression spring, said compression spring encircling the sleeve and acting at one end against an abutment carried by the sleeve, the spring acting at its other end against the barrier member, the spring urging the pinion gear wheel assembly to its rest position.

2. A starter motor as claimed in claim 1 wherein the barrier member abuts an annular gasket interposed between the member and an annular shoulder on the housing, said spring serving to trap the barrier member against said shoulder of the housing.

3. A starter motor as claimed in claim 1 or claim 2 wherein the seal is interposed between the spring and the barrier member.

4. A starter motor as claimed in claim 3 wherein the spring traps the seal against the barrier member.

5. A starter motor as claimed in claim 1 or claim 3 wherein the seal is secured to the face of the barrier member opposite to the face engaged by the spring.

* * * * *